US012722861B2

(12) United States Patent
D'Alfonso et al.

(10) Patent No.: US 12,722,861 B2
(45) Date of Patent: Sep. 1, 2026

(54) BREAK-OPEN PACK AND PRODUCTION METHOD THEREOF

(71) Applicant: G.D S.P.A., Bologna (IT)

(72) Inventors: Lorena D'Alfonso, Lettomappello (IT); Roberto Polloni, Bologna (IT)

(73) Assignee: G.D S.P.A., Bologna (IT)

( * ) Notice: Subject to any disclaimer, the term of this patent is extended or adjusted under 35 U.S.C. 154(b) by 8 days.

(21) Appl. No.: 18/859,656

(22) PCT Filed: Apr. 24, 2023

(86) PCT No.: PCT/IB2023/054181
§ 371 (c)(1),
(2) Date: Oct. 24, 2024

(87) PCT Pub. No.: WO2023/209535
PCT Pub. Date: Nov. 2, 2023

(65) Prior Publication Data

US 2025/0289638 A1 Sep. 18, 2025

(30) Foreign Application Priority Data

Apr. 27, 2022 (IT) ..... 102022000008255

(51) Int. Cl.
*B65D 75/36* (2006.01)
*B65B 5/04* (2006.01)
(Continued)

(52) U.S. Cl.
CPC ..... *B65D 75/366* (2013.01); *B65B 5/04* (2013.01); *B65D 75/5833* (2013.01); *B65D 85/07* (2018.01)

(58) Field of Classification Search
CPC .. B65D 75/5833; B65D 85/07; B65D 75/366; B65D 75/5872; B65D 75/32; B65D 75/36
(Continued)

(56) References Cited

U.S. PATENT DOCUMENTS 2,892,538 A * 6/1959 Middleton, Jr. ..... A61M 5/002 206/469
3,289,831 A * 12/1966 Keating, Jr. ..... B65D 75/366 206/469
(Continued)

FOREIGN PATENT DOCUMENTS

EP 2210508 A1 7/2010
WO WO-2014124939 A1 8/2014
(Continued)

OTHER PUBLICATIONS

International Application No. PCT/IB2023/054181, International Search Report and Written Opinion, mailed Aug. 18, 2023.

*Primary Examiner* — Chun Hoi Cheung
(74) *Attorney, Agent, or Firm* — MARSHALL, GERSTEIN & BORUN LLP

(57) ABSTRACT

A sealed break-open pack (1) having: at least one product (5), in particular of the tobacco processing industry; a rigid sheet (2); a flexible sheet (3), which is arranged on top of and is fixed to the rigid sheet (2) so as to define a pocket (4) housing the product (5); and a pre-weakened area (6), which is obtained in the rigid sheet (2) in order to guide, following a "U"-shaped folding of the rigid sheet (2), a controlled breaking of the rigid sheet (2) in the pre-weakened area (6) so as to cause the formation of an output opening for the product (5) through the rigid sheet (2). The pre-weakened area (6) has a non-through incision (7) which is "U"-shaped, is obtained through a surface of the rigid sheet (2), and partially surrounds the product (5) housed in the pocket (4).

17 Claims, 8 Drawing Sheets

(51) Int. Cl.
*B65D 75/58* (2006.01)
*B65D 85/07* (2017.01)

(58) Field of Classification Search
USPC ..... 206/491, 461–471
See application file for complete search history.

(56) References Cited

U.S. PATENT DOCUMENTS 3,811,564 A * 5/1974 Braber ..... B65D 75/5833 206/469
4,119,203 A * 10/1978 Kuchenbecker ..... B65D 75/368 206/467
4,200,193 A * 4/1980 Boyle ..... B65D 75/366 206/467
4,300,682 A * 11/1981 Kuchenbecker ..... B65D 75/366 206/467
6,543,209 B1 * 4/2003 Siegel ..... B65D 75/366 206/532
7,552,823 B2 * 6/2009 Schuehrer ..... A61M 35/006 206/581
8,225,932 B2 * 7/2012 Burattini ..... B65D 75/585 222/541.6
10,159,823 B2 * 12/2018 Tidwell ..... B65D 75/585
11,220,387 B2 * 1/2022 Gustvasson ..... B65D 75/585
2006/0283727 A1 * 12/2006 Nelson ..... B65D 75/585 206/219
2010/0155284 A1 * 6/2010 Gerstle ..... B65D 75/5827 206/524.6
2011/0272309 A1 * 11/2011 Miller ..... B65D 73/005 206/349
2013/0209000 A1 8/2013 Owensby et al.
2014/0231296 A1 * 8/2014 Reggio ..... B65D 75/585 206/484
2016/0375233 A1 * 12/2016 Tidwell ..... B65D 75/585 604/310
2021/0078765 A1 3/2021 Evelich et al.

FOREIGN PATENT DOCUMENTS

WO WO-2016202594 A1 12/2016
WO WO-2022/059042 A1 3/2022

* cited by examiner

BREAK-OPEN PACK AND PRODUCTION METHOD THEREOF

CROSS-REFERENCE TO RELATED APPLICATIONS

This patent application is a U.S. national stage of PCT/IB2023/054181, filed Apr. 24, 2023, which claims priority from Italian Patent Application No. 102022000008255 filed on Apr. 27, 2022, the entire disclosure of which is incorporated herein by reference.

TECHNICAL FIELD

The present invention relates to a sealed break-open pack and to a corresponding production method thereof.

The present invention finds advantageous application to a sealed pack containing (at least) a pouch of snus (namely, a permeable pouch containing a prepacked dose of a moist nicotine-based product for oral use), to which the following disclosure will make explicit reference without thereby loosing generality.

PRIOR ART

Currently, snus pouches are grouped together to form groups of 4-30 snus pouches, which are placed in containers made of plastic material (or more rarely made of metal material); some examples of snus containers given are in patent applications WO2014124939A1, EP2210508A1 and WO2016202594A1.

The snus pouches must maintain a relatively high humidity on the inside, as the product they contain has the expected organoleptic characteristics only if adequately moist. However, whenever a container containing a group of snus pouches is opened, its inner atmosphere mixes with the environment atmosphere inevitably losing some moisture; as a result, the snus pouches that are picked last tend to be too dry and therefore unsatisfactory for the final user.

To solve this drawback, a blister pack could be made for snus pouches. However, said solution is not feasible since in order to push a snus pouch out of its cell by breaking the aluminium wall it is necessary to apply a considerable pressure on the snus pouch which excessively deforms the snus pouch and could cause the same to lose part of its humidity.

Patent application WO2022059042A1 describes a single-dose sealed break-open pack comprising: a first sheet of semi-rigid plastic material and a second sheet of flexible plastic material, which is arranged on top of and is sealed to the first sheet so as to form a sealed pocket which contains a dose of product. At least one incision is provided in the first sheet to guide, upon folding the sealed pack, the controlled breaking of the first sheet in the area of the incision, thereby causing the formation of an opening through the first sheet.

DESCRIPTION OF THE INVENTION

The object of the present invention is to provide a sealed break-open pack and a corresponding production method which do not have the drawbacks described above and therefore allow particularly soft and deformable articles to be housed in individual pockets (cells).

According to the present invention, a sealed break-open pack and a corresponding production method are provided, according to what is claimed in the attached claims.

The claims describe preferred embodiments of the present invention forming an integral part of the present description.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 1:
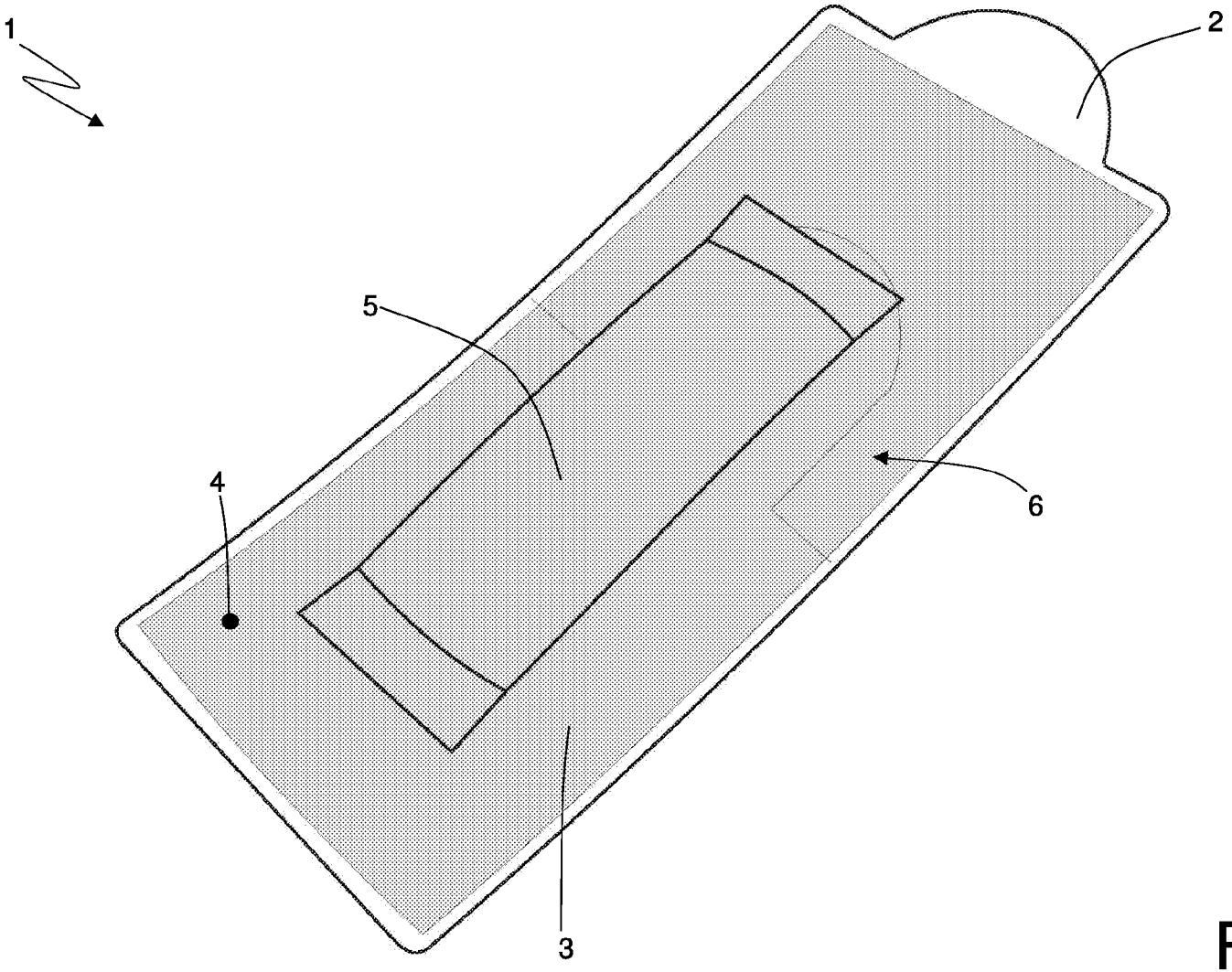
FIG. 1 is a perspective view and in a closed condition of a sealed break-open pack which houses a pouch of snus and is obtained according to the present invention.

In FIGS. 1-6, number 1 denotes as a whole a single-dose sealed break-open pack. The single-dose sealed pack 1 comprises a rigid and substantially rectangular sheet 2 and a flexible and substantially rectangular sheet 3 (shown only in FIG. 1), which is arranged on top of and is sealed to the rigid sheet 2 so as to define a sealed pocket 4 that contains a product (specifically a pouch of snus) 5.

It is important to note that the rigid sheet 2 is designed to be (substantially) more rigid than the flexible sheet 3; similarly, the flexible sheet 3 designed is to be (substantially) more flexible than the rigid sheet 2. Basically, when folded in a "U"-shape the rigid sheet 2 breaks (also due to a localized weakening as described in the following) while the flexible sheet 3 elastically deforms without being damaged.

The rigid sheet 2 has a substantially rectangular shape having two longer (longitudinal) bigger sides and two shorter (transversal) smaller sides; roughly, the bigger sides are twice as long as the smaller sides.

The rigid sheet 2 centrally has a pre-weakened area 6 (better illustrated in FIG. 6), which is obtained in a central area of the rigid sheet 2 (in particular in a longitudinally centred area) in the area of the pocket 4 and guides a controlled breaking of the rigid sheet 2 so as to cause, following a "U"-shaped folding of the rigid sheet 2 (namely, of the pack 1), the formation through the rigid sheet 2 of an opening for the product 5 to come out.

Figure 2:
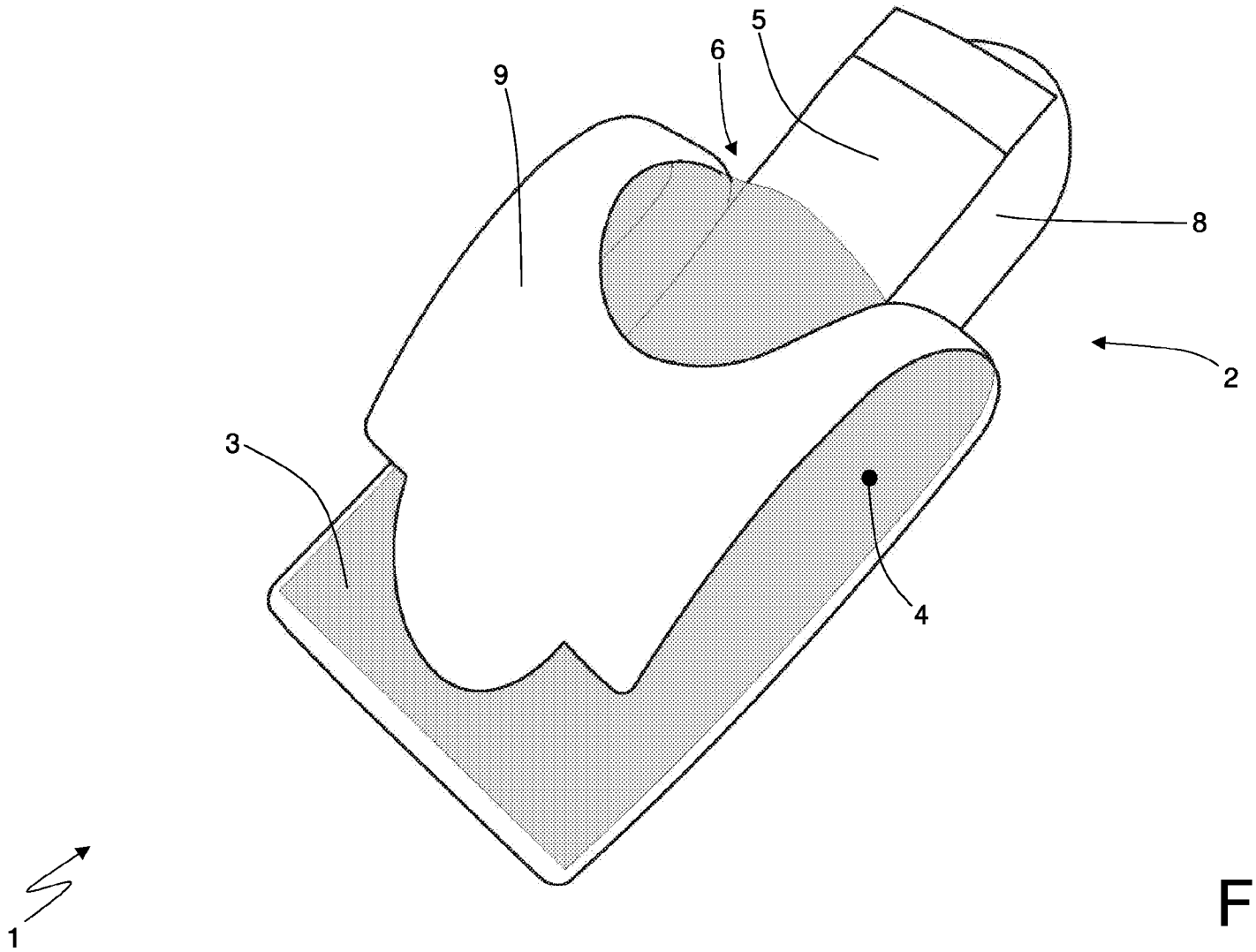
FIG. 2 is a perspective view and in an open condition of the sealed pack of FIG. 1.

In other words, in order to open the sealed pack 1 (preferably single-dose) a user must grasp the sealed pack 1 with the fingers of one hand and fold the sealed pack 1 in a "U"-shape until the rigid sheet 2 is broken at the pre-weakened area 6 (as illustrated in FIG. 2). By breaking the rigid sheet 2 at the pre-weakened area 6, the product 5 can be extracted from the sealed pack 1 in a simple and hygienic way.

The pre-weakened area 6 comprises a single non-through incision 7 which is "U"-shaped and is obtained through a surface of the rigid sheet 2. According to a preferred embodiment (better illustrated in FIG. 9) the incision 7 is obtained through an outer surface (namely, opposite the pocket 4) of the rigid sheet 2; according to an alternative embodiment, the incision 7 is obtained through an inner surface (namely, facing the pocket 4) of the rigid sheet 2. According to a further embodiment, the pre-weakened area 6 comprises an outer incision which is obtained through an outer surface (namely, opposite the pocket 4) of the rigid sheet 2 and an inner incision which is superimposed on the outer incision is transversely oriented and is obtained through an inner surface (namely, facing the pocket 4) of the rigid sheet 2.

The incision 7 partially surrounds the product housed in the pocket 4. In particular, the incision 7 surrounds and partially contains the product 5 housed in the pocket 4. In other words, the incision 7 is not superimposed on the product 5 but is arranged all around to product 5; in this way, by folding the rigid sheet 2 in a "U"-shape, the rigid sheet 2 becomes split, breaking along the incision 7, into an inner portion 8, which remains in contact with the product 5 (making up a sort of "tray" on which the product 5 remains positioned), and an outer portion 9, which is distant from the product 5 (and from the inner portion 8) without touching (therefore deforming) the product 5 so as to open the pack 1 and allow the extraction of the product 5.

In other words, the incision 7 surrounds and contains the product 5 housed in the pocket and therefore the breaking of the rigid sheet 2 takes place around the product (outside the product); consequently, the outer portion 9 of the rigid sheet 2 moving away from the inner portion 8 of the rigid sheet 2 during the opening of the pack 1 does not touch (and therefore does not subject to mechanical stresses) the product 5.

Figure 3:
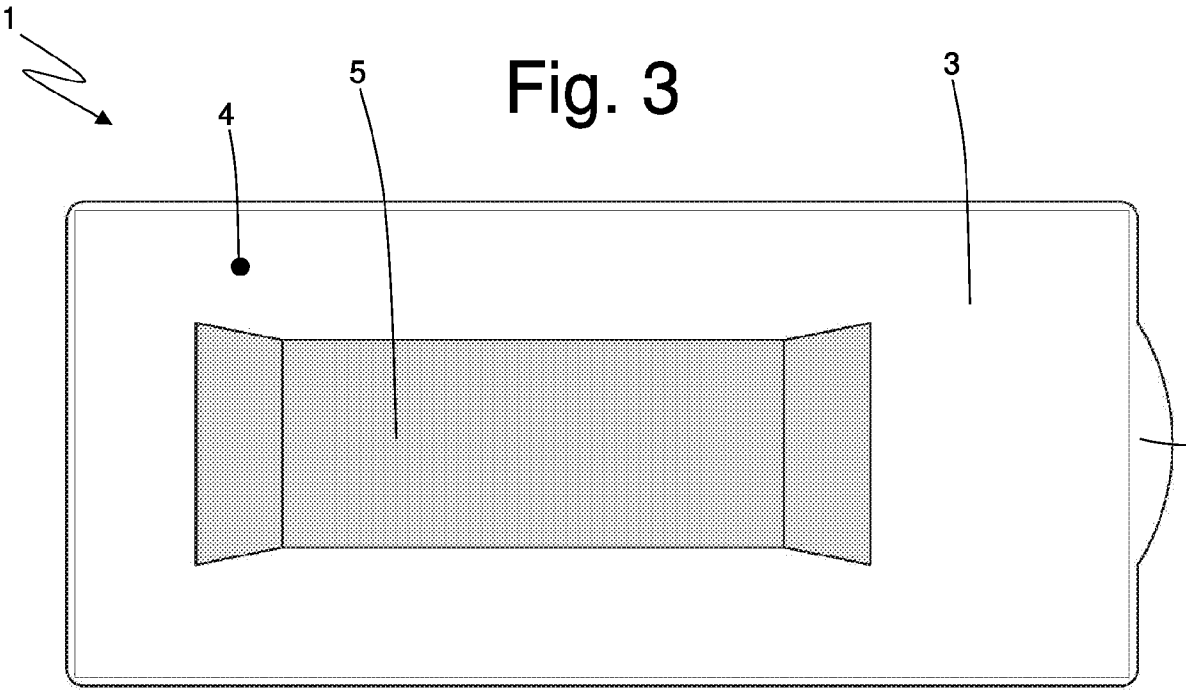
FIGS. 3-6 are a top view, a front view, a side view and a bottom view of the sealed pack of FIG. 1, respectively.
Figure 5:
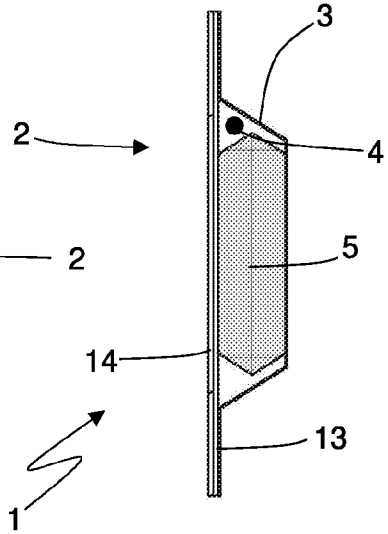
Figure 4:
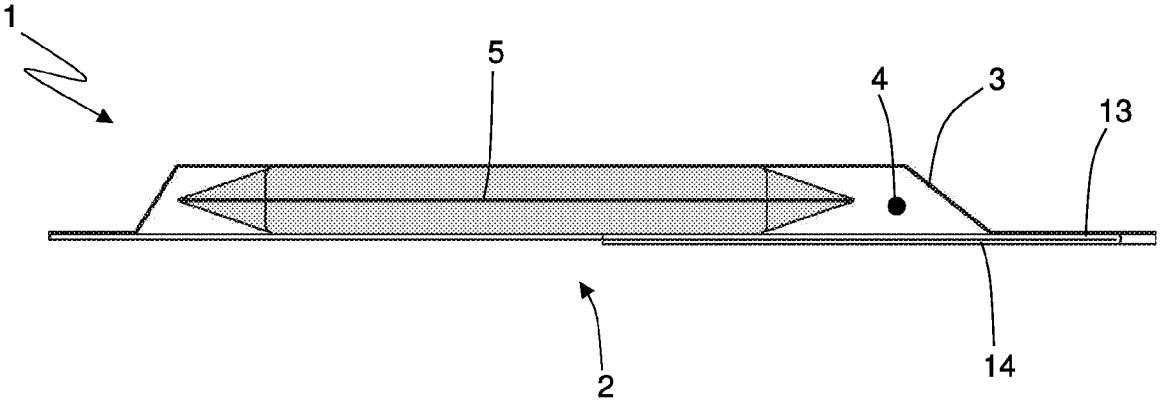
Figure 6:
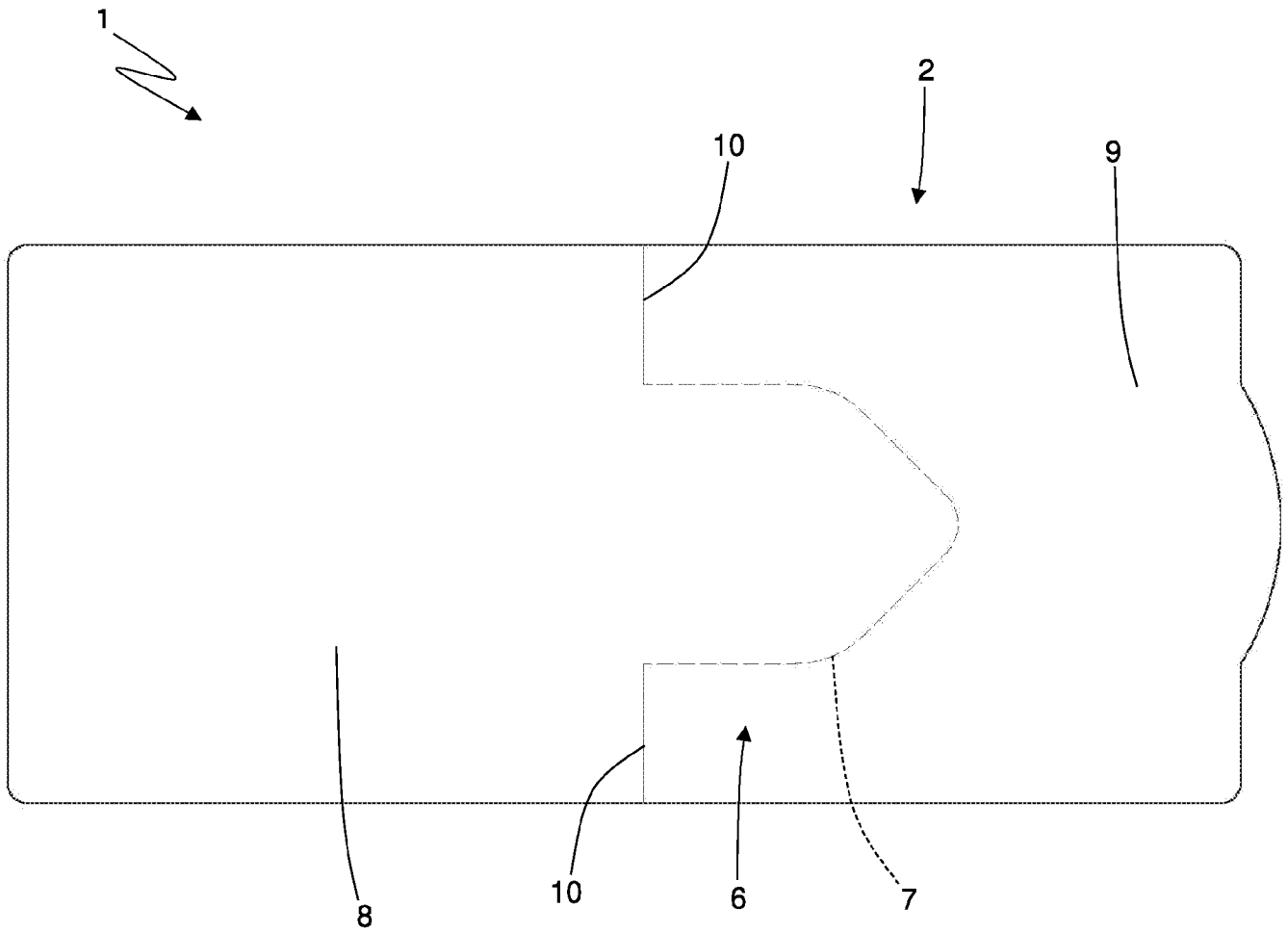

According to a preferred embodiment better illustrated in FIGS. 3 and 6, the rigid sheet 2 has two pre-weakened folding lines 10 which guide (facilitate) the "U"-shaped folding of the rigid sheet 2 (namely, of the pack 1), are aligned with one another, are arranged on opposite sides of the incision 7 and each originates from one end of the incision 7 in order to end in the area of an outer edge of the rigid sheet 2. In particular, the two pre-weakened folding lines 10 are formed by a weakening, without any cut, of the material making up the rigid sheet 2 and preferably consists of a creasing (namely, by an embossing which is carried out in order to facilitate the folding thereof and thus avoiding deformation and cracking).

According to a preferred embodiment, the incision 7 is continuous, namely has no interruptions, along its entire extension. According to a preferred embodiment, the incision 7 has a constant depth along its entire extension. According to a preferred embodiment (illustrated in FIG. 9), the incision 7 has a depth that is equal to 50% of an overall thickness of the rigid sheet 2.

Figure 9:
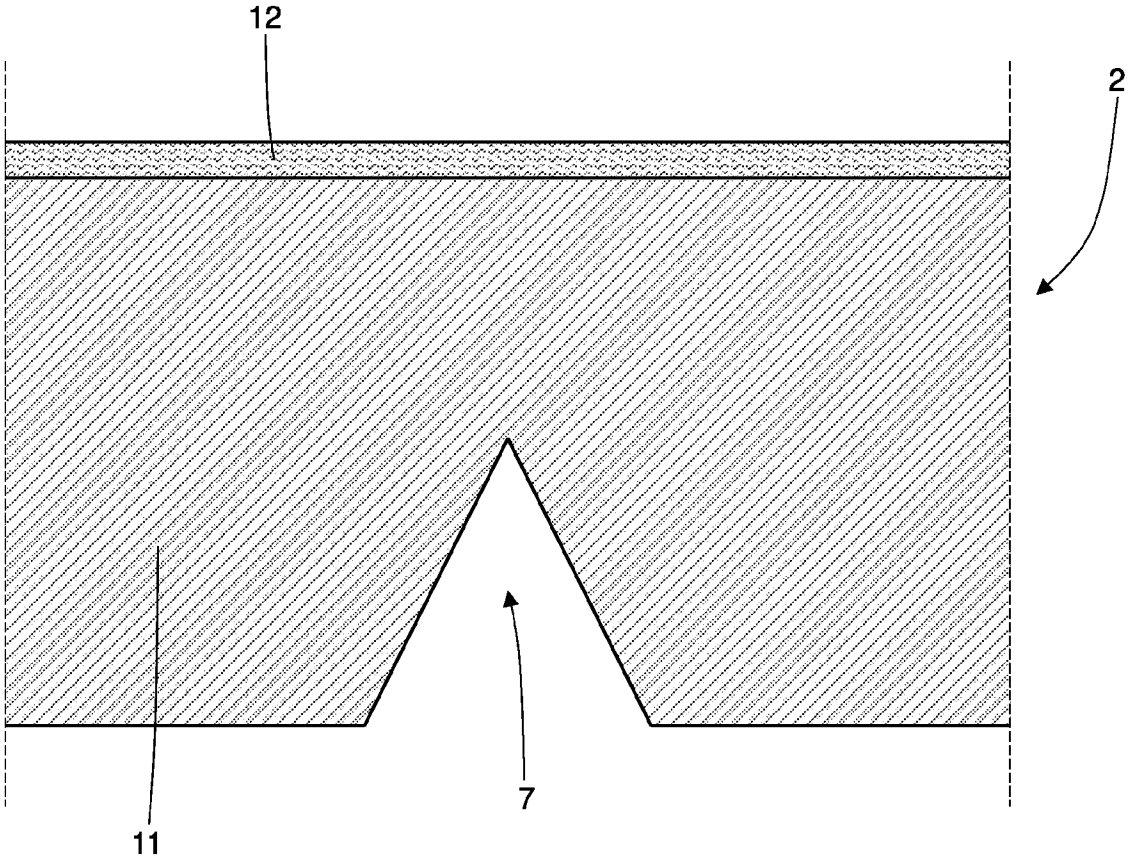
FIG. 9 is a sectional view of part of a rigid sheet of the sealed pack of FIG. 1.

As illustrated in FIG. 9, the rigid sheet 2 is made of polyethene coated paper and therefore comprises a supporting layer 11 (of greater thickness) made of paper (for example Kraft paper or the like) and a heat-sealable layer 12 (of a lesser thickness) made of extruded polyethylene. In particular, a mono-polythene paper is used (namely, with the extruded polyethylene on one side only). The supporting layer 11 is arranged on the outer side (that is, on the side opposite the pocket 4) and is affected by the incision 7 (which extends exclusively to the supporting layer 11), whereas the heat-sealable layer 12 is arranged on the inside (namely, on the side of the pocket 4) as it is to be joined by heat sealing to the flexible sheet 3. An insulating or barrier layer can be provided between the supporting layer 11 and the heat-sealable layer 12 with the purpose of guaranteeing airtightness.

Alternatively, the rigid sheet 2 could be made of any material which allows the fixing (preferably by sealing) on the same of the flexible sheet 3 and the formation of the incision 7.

Preferably, the flexible sheet 3 is normally made of a heat-sealable plastic material.

Figure 7:
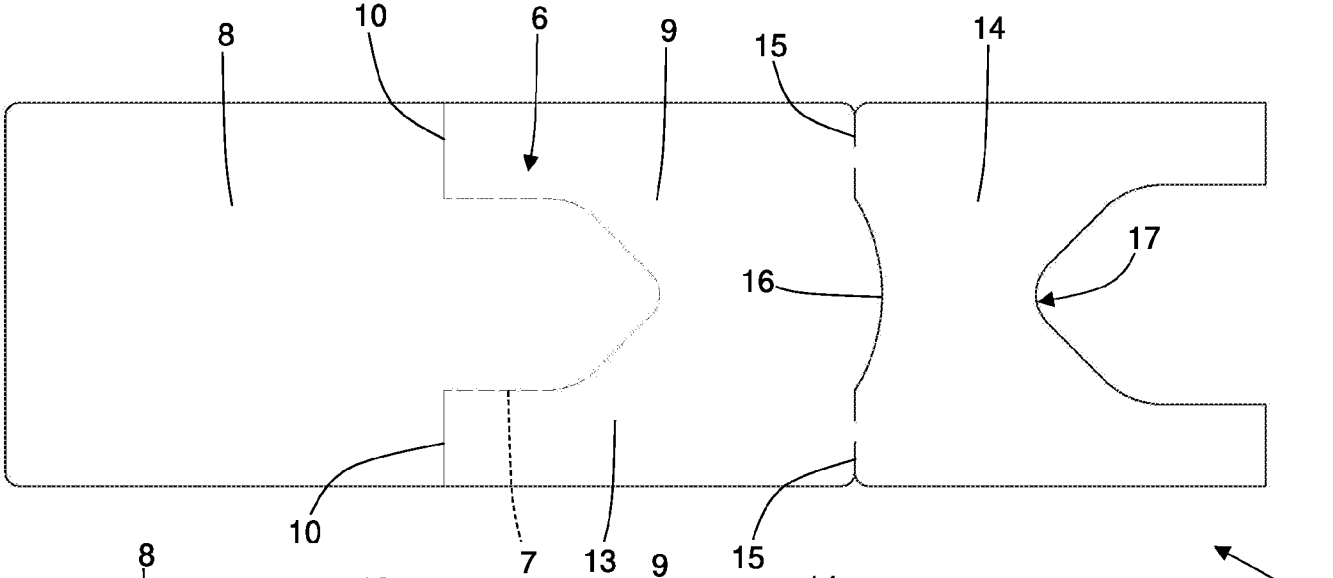
FIGS. 7 and 8 are an unfolded view and a folded view, respectively, of a rigid sheet suited to obtain the sealed pack of FIG. 1.
Figure 8:
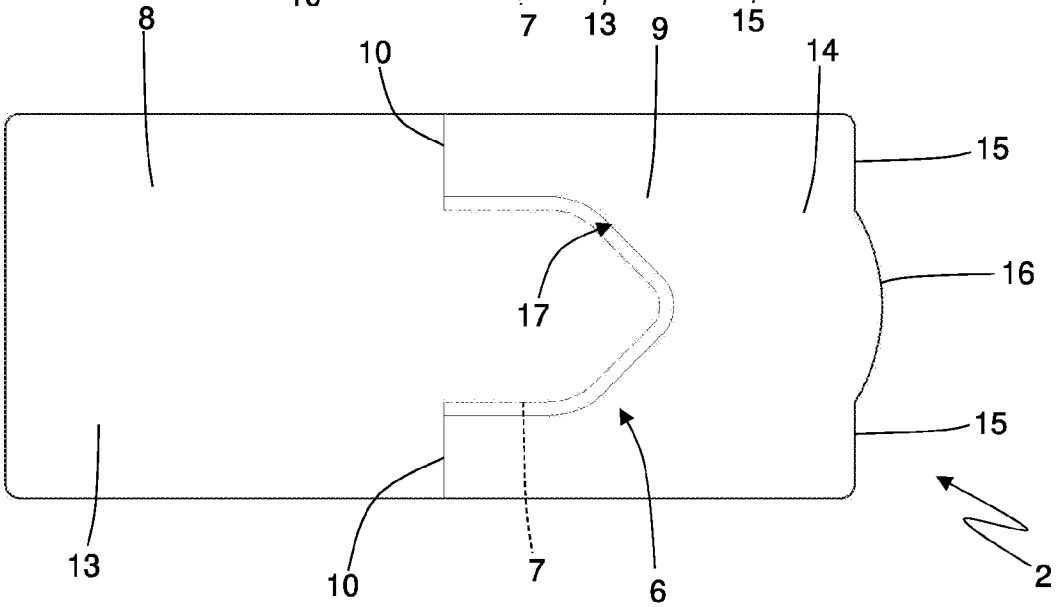

According to a preferred embodiment better illustrated in FIGS. 7 and 8, the rigid sheet 2 has a main part 13 on which the flexible sheet 3 is fixed in order to define the pocket 4 and an (additional) reinforcement part 14, which is connected to the main part 13 along at least one pre-weakened folding line 15 (typically a creasing) and is folded by 180° against the main part 13 on the opposite side of the pocket 4. In other words, the reinforcement part 14 doubles the thickness of the rigid sheet 2 in one half (approximately) of the same rigid sheet 2 by being placed and glued to the main part 13 on the opposite side of the pocket 4.

According to a preferred embodiment illustrated in the attached figures, the rigid sheet 2 has two folding lines 15 which are aligned with one another and are separated by a through cut 16 which is "U"-shaped; in this way, the through cut defines a small "protuberance" of the rigid sheet 2 which indicates where the user must grasp the rigid sheet 2 to proceed with the "U"-shaped folding of the rigid sheet 2 (namely, of the pack 1) and then open pack 1.

The reinforcement part 14 of the rigid sheet 2 does not overlap the incision 7 so as not to hinder the controlled breaking of the rigid sheet 2 along the incision 7 when the pack 1 is folded in a "U"-shape. According to a preferred embodiment illustrated in the attached figures, the reinforcement part 14 of the rigid sheet 2 has a through opening 17 which is "U"-shaped and surrounds the incision 7, namely, it is (slightly) wider than the incision 7 in order to enclose the incision 7 inside the same with little clearance.

In the embodiment illustrated in the attached figures, the reinforcement part 14 overlaps the main part 13 of the rigid sheet 2 at the movable area (half), which is rotated when the pack 1 is folded in a "U"-shape; alternatively, the reinforcement part 14 overlaps the main part 13 of the rigid sheet 2 at the fixed area (half), which is held in place when the pack 1 is folded in a "U"-shape. According to a further embodiment, the rigid sheet 2 comprises two different reinforcement parts 14 arranged at the opposite ends of the rigid sheet 2 and suited to reinforce both the movable area (half) and the fixed area (half).

Figure 10:
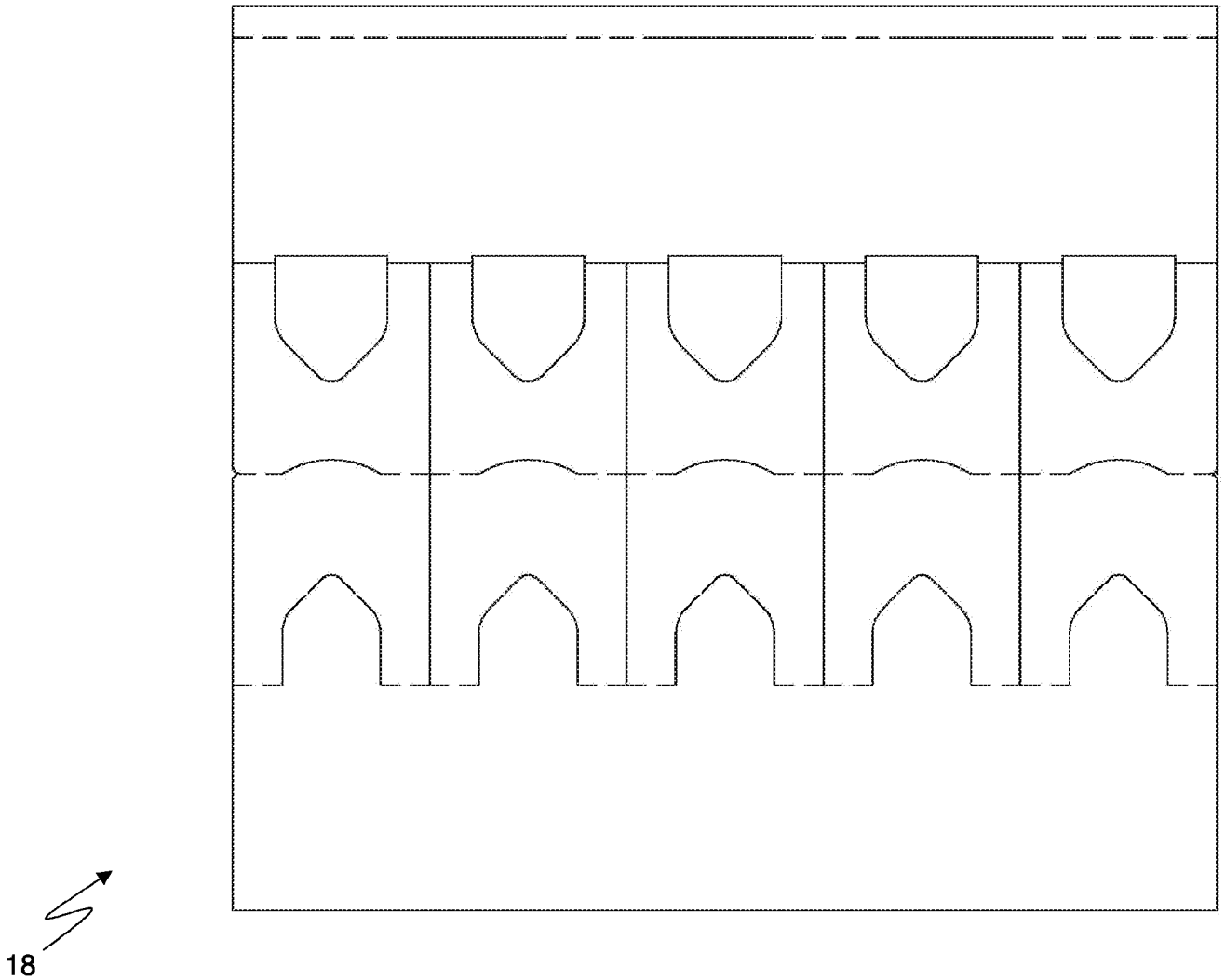
FIG. 10 is an unfolded view of a rigid sheet suited to obtain a plurality of sealed packs illustrated in FIG. 1.
Figure 11:
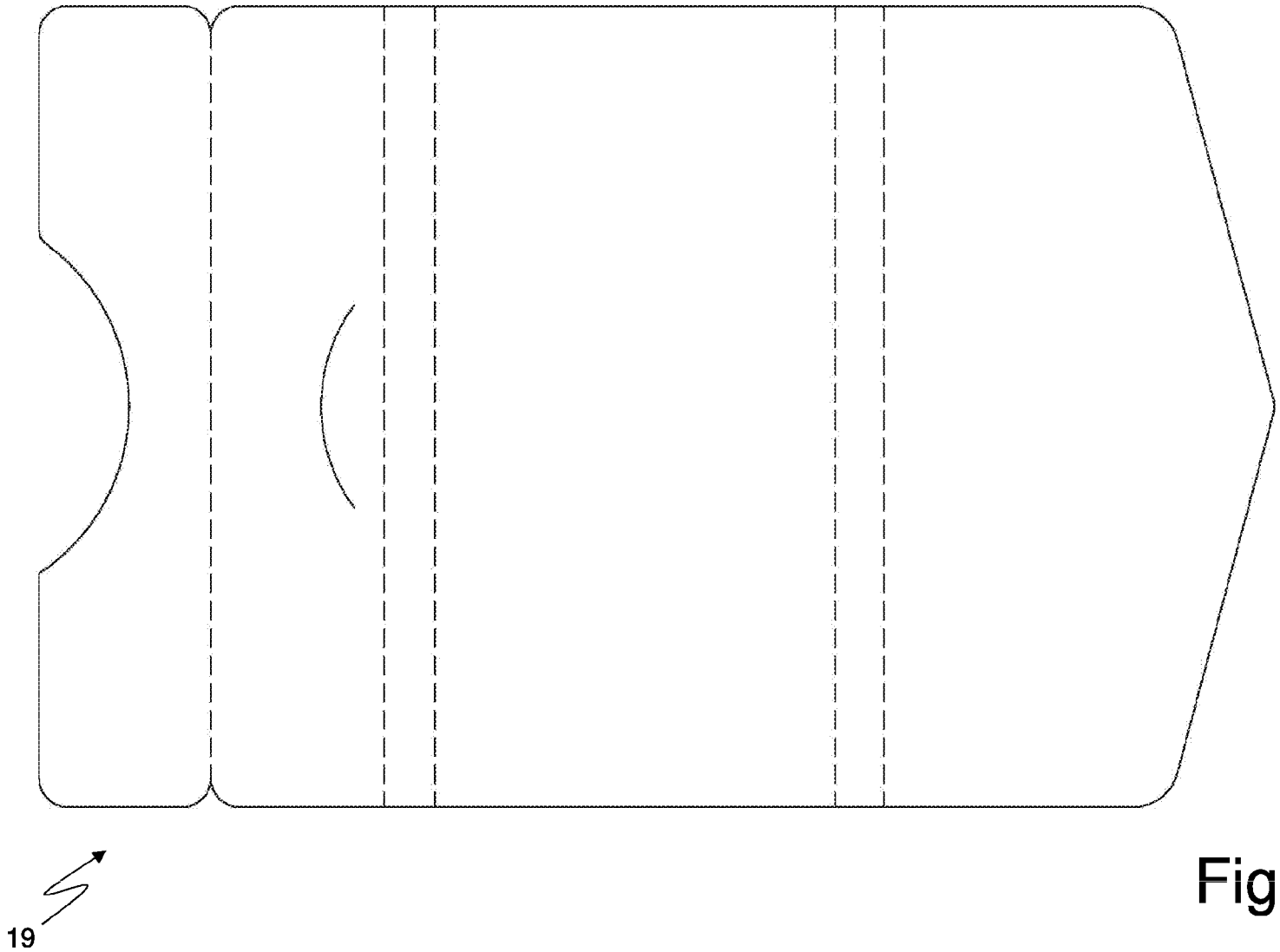
FIG. 11 is an unfolded view of a blank suited to obtain an outer casing of the plurality of sealed packs of FIG. 10.

In the embodiment illustrated in FIGS. 1-8, the pack 1 is single, namely, it comprises a single pocket 4 that contains a single product 5. In the embodiment illustrated in FIG. 10, a plurality of packs 1 are provided (in particular five packs 1) placed side by side and initially joined (possibly along respective tearable joining lines); in particular, FIG. 10 illustrates a single blank 18 which allows to obtain five rigid sheets 2 placed side by side. The plurality of packs 1 can be inserted into an outer casing which is obtained by folding the blank 19 illustrated in FIG. 11.

The production of the pack 1 described above provides for unwinding, from a reel, a continuous strip of flexible material that defines the flexible sheets 3 and for unwinding, from another reel, a continuous strip of rigid material which defines the rigid sheets 2. In particular, the continuous strip of rigid material that defines the rigid sheets 2 can be wound into a reel already comprising the incisions 7 or said incisions 7 can be obtained following the unwinding of the reel, for example by means of one or more incision knives for the continuous strip.

Subsequently, the continuous strip of flexible material which defines the flexible sheets 3 and the continuous strip of rigid material which defines the rigid sheets 2 are placed on top of one another and fixed together (in particular heat-sealed) so as to define a succession of pockets 4 open on one side between the two strips. Subsequently, the products 5 are inserted into the corresponding pockets 4 and finally the fixing (heat-sealing) of the two strips is completed to seal (completely close) the pockets 4.

In particular, the step of fixing the two strips together so as to define the succession of pockets 4 open on one side can be performed by obtaining a bellow portion in the continuous strip of flexible material which defines the flexible sheets 3 so that, each pocket 4 can be widened before inserting the product 5 into the pocket 4. In other words, a bellows-like portion is made in the flexible sheet 3 (in the continuous strip of flexible material which defines the flexible sheets 3) so that the pocket 4 (open on one side) can be enlarged by extending the bellows; then, pocket 4 is widened before inserting product 5 inside pocket 4 (through the open side) and product 5 is inserted into pocket 4 after having widened the pocket 4. Obviously, the pocket 4 is sealed after having inserted the product 5. The pack 1 described above contains (at least) one product 5 consisting of a pouch of snus (namely, a tobacco-based product and of the tobacco processing industry); alternatively, the pack 1 described above could contain a different product of the tobacco processing industry or another type of product.

The embodiments described herein can be combined with one another without departing from the scope of the present invention.

The pack 1 described above has numerous advantages.

In the first place, the pack 1 described above allows a product 5 to be housed individually in a corresponding sealed pocket 4.

Furthermore, the pack 1 described above allows a very simple and quick opening to extract the product 5 and above all the opening of the pack 1 does not subject the product 5 to any type of stress (deformation or crushing): as well illustrated in FIG. 2, the opening of the pack 1 takes place all around the product 5 and without affecting the product 5 in any way. In other words, the opening of the pack 1 described above is made as easy as possible by requiring a single and simple gesture (the "U"-shaped folding of the pack) which forms an opening only on the rigid sheet 2 (rear) avoiding delaminating or cutting the flexible sheet 3 (front); furthermore, during the opening of the pack 1, crushing and pressure on the product 5 arranged inside the pocket 4 of the pack is avoided, as would instead occur in normal blisters.

Finally, the pack 1 described above is simple and inexpensive to produce since the production thereof requires a limited number of operations which can be easily automated.

LIST OF REFERENCE NUMBERS OF THE FIGURES

1 pack
2 rigid sheet
3 flexible sheet
4 pocket
5 product
6 pre-weakened area
7 incision
8 inner portion
9 outer portion
10 folding lines
11 supporting layer
12 heat-sealable layer
13 main part
14 reinforcement part
15 folding lines
16 through cut
17 through opening
18 blank
19 blank

The invention claimed is:

1. A sealed break-open pack (1) comprising:

at least one product (5);

a rigid sheet (2);

a flexible sheet (3), which is arranged on top of and is fixed to the rigid sheet (2) so as to define a pocket (4) housing the product (5); and a pre-weakened area (6), which is obtained in the rigid sheet (2) in order to guide, following a "U"-shaped folding of the rigid sheet (2), a controlled breaking of the rigid sheet (2) in the pre-weakened area (6) so as to cause the formation of an output opening for the product (5) through the rigid sheet (2);

wherein the pre-weakened area (6) comprises a non-through incision (7), which is "U"-shaped and is obtained through a surface of the rigid sheet (2); and wherein the incision (7) partially surrounds the product (5) housed in the pocket (4);

wherein the rigid sheet (2) has a main part (13), on which the flexible sheet (3) is fixed in order to define the pocket (4), and a reinforcement part (14), which is connected to the main part (13) along at least a second folding line (15), is folded by 180° against the main part (13) on the opposite side of the pocket (4) and overlaps the main part (13) on the opposite side of the pocket (4);

wherein the reinforcement part (14) of the rigid sheet (2) has a through opening (17), which is "U"-shaped and surrounds the incision (7).

2. The sealed pack (1) according to claim 1, wherein the incision (7) surrounds the product (5) housed in the pocket (4) so that, by folding the rigid sheet (2) in a "U"-shape, the rigid sheet (2) becomes split, breaking along the incision (7), into an inner portion (8), which remains in contact with the product (5), and an outer portion (9), which is distant from the product (5).

3. The sealed pack (1) according to claim 1, wherein the rigid sheet (2) has two first pre-weakened folding lines (10), which guide the "U"-shaped folding of the rigid sheet (2), are aligned with one another, are arranged on opposite sides of the incision (7) and each originate from an end of the incision (7) in order to end in the area of an outer edge of the rigid sheet (2).

4. The sealed pack (1) according to claim 3, wherein the first pre-weakened folding lines (10) consist of a weakening, without any cut, of the material making up the rigid sheet (2).

5. The sealed pack (1) according to claim 1, wherein the reinforcement part (14) of the rigid sheet (2) is glued to the main part (13) of the rigid sheet (2).

6. The sealed pack (1) according to claim 1 wherein the rigid sheet (2) has two second folding lines (15), which are aligned with one another and are separated by a through cut (16).

7. The sealed pack (1) according to claim 6, wherein the through cut (16) is "U"-shaped.

8. The sealed pack (1) according to claim 1, wherein the reinforcement part (14) of the rigid sheet (2) does not overlap the incision (7).

9. The sealed pack (1) according to claim 1, wherein the incision (7) is continuous, namely has no interruptions, along its entire extension.

10. The sealed pack (1) according to claim 1, wherein the incision (7) has a constant depth along its entire extension.

11. The sealed pack (1) according to claim 1, wherein the incision (7) has a depth that is equal to 50% of a thickness of the rigid sheet (2).

12. The sealed pack (1) according to claim 1, wherein the through opening (17) reproduces in negative the shape of the incision (7).

13. The sealed pack (1) according to claim 1, wherein the through opening (17) is wider than the incision (7) in order to enclose the incision (7) inside the same.

14. The sealed pack (1) according to claim 1, wherein the through opening (17) is wider than the incision (7) in order to enclose the incision (7) inside the same with little clearance.

15. The sealed pack (1) according to claim 1, wherein the product (5) is of the tobacco processing industry.

16. A method for the production of a sealed break-open pack (1) and comprising the steps of:

feeding a rigid sheet (2) and a flexible sheet (3), which, once coupled, define a pocket (4) suited to house a product (5), wherein the rigid sheet (2) has a main part (13), on which the flexible sheet (3) is fixed in order to define the pocket (4), and a reinforcement part (14), which is connected to the main part (13) along a folding line (15);

obtaining, in the rigid sheet (2), a pre-weakened area (6) to guide, following a "U"-shaped folding of the rigid sheet (2), a controlled breaking of the rigid sheet (2) in the pre-weakened area (6) so as to cause the formation of an output opening for the product (5) through the rigid sheet (2);

placing the rigid sheet (2) and the flexible sheet (3) on top of one another and fixing them in order to define the pocket (4) open on one side;

inserting the product (5) into the pocket (4); and sealing the pocket (4) after having inserted the product (5);

wherein the step of obtaining, in the rigid sheet (2), a pre-weakened area (6) comprises the step of obtaining, through the rigid sheet (2), a non-through incision (7), which is "U"-shaped and partially surrounds the product (5) housed in the pocket (4), and wherein the reinforcement part (14) is folded by 180° against the main part on the opposite side of the pocket (4) and overlaps the main part (13) on the opposite side of the (4), and the reinforcement part (14) has a through opening (17) which is "U"-shaped and surrounds the incision (7).

17. The method according to claim 16, wherein the product (5) is of the tobacco processing industry.

* * * * *